US006044364A

United States Patent [19]

DeFilippo et al.

[11] Patent Number: 6,044,364

[45] Date of Patent: Mar. 28, 2000

[54] METHOD AND APPARATUS FOR ENSURING FOR THE CORRECT ACCOUNTING OF POSTAGE DISPENSED BY A POSTAGE METER

[75] Inventors: Craig J. DeFilippo, Milford; Joseph M. Mozdzer, Beacon Falls; Charles F. Murphy, III, Milford, all of Conn.

[73] Assignee: Pitney Bowes Inc., Stamford, Conn.

[21] Appl. No.: 08/986,811

[22] Filed: Dec. 8, 1997

[51] Int. Cl.[7] ..... G07B 17/02

[52] U.S. Cl. ..... 705/404

[58] Field of Search ..... 705/410, 401, 705/404, 403

[56] References Cited

U.S. PATENT DOCUMENTS

| | | | |
|---|---|---|---|
| 4,802,218 | 1/1989 | Wright et al. | 380/23 |
| 5,655,024 | 8/1997 | Bell et al. | 380/51 |
| 5,731,980 | 3/1998 | Dolan et al. | 705/410 |
| 5,799,093 | 8/1998 | French et al. | 380/51 |
| 5,812,400 | 9/1998 | Eddy et al. | 705/410 |

*Primary Examiner*—Emanuel Todd Voeltz
*Assistant Examiner*—Thomas A. Dixon
*Attorney, Agent, or Firm*—Steven J. Shapiro; Michael E. Melton

[57] ABSTRACT

A postage metering system which performs a plurality of different functions including printing of postage and exchange of data with a remotely located data center to accomplish a postage fund refill of the postage metering system, a remote postage metering system inspection, and a download of location data into the postage metering system is provided and further includes a portable vault having first data indicative of location stored therein, the portable vault accounting for the value of postage printed; and a terminal which houses structure for removably receiving the portable vault, a printing mechanism for printing postage, apparatus for communicating with the data center to perform the remote postage metering system inspection, the postage fund refill of the postage metering system, and the download of location data into the postage metering system, structure for storing second data indicative of location, and apparatus for comparing the first and second data at times when the portable vault is inserted in the receiving means, for permitting operation of all of the plurality of different functions if the first and second data match, and for preventing the printing of postage while permitting the operation of at least some of the other of the plurality of different functions if the first and second data do not match. A method associated with the postage metering system is also provided.

9 Claims, 4 Drawing Sheets

METHOD AND APPARATUS FOR ENSURING FOR THE CORRECT ACCOUNTING OF POSTAGE DISPENSED BY A POSTAGE METER

BACKGROUND OF THE INVENTION

The instant invention relates to postage metering systems utilizing portable postage vaults, and more particularly to a method and apparatus for ensuring that revenue generated by the portable postage vaults is properly credited to the specific post office which actually initiates the processing of any specific mailpiece.

Postage meters of both the electronic and mechanical variety have conventionally had all of the accounting and printing control structure contained in a secure single housing in order to protect against tampering. Recently, however, advances in microelectronics, digital printing, and encryption techniques have led to the design of modular postage metering systems such as those disclosed in U.S. Pat. No. 4,802,218 issued to Wright et al. and U.S. Pat. application Ser. No. 08/702,077 filed Aug. 23, 1996 now U.S. Pat. No. 5,812,400 and entitled "ELECTRONIC POSTAGE METER INSTALLATION AND LOCATION MOVEMENT SYSTEM" which is hereby incorporated by reference. In these newer systems, the postage accounting vault is a portable device, such as a smart card, which can be removably inserted into a base module containing the metering system interface controls and a removable printhead module. Since all of the components are easily accessible and not contained within a single secure housing, security is provided via encrypted communications between the various metering system modules. Moreover, it has been proposed to utilize encrypted information, which is printed together with the postage indicia for increasing security relative to fraudulently printed postage indicia. That is, the printed encrypted information on any mailpiece can be subsequently scanned and analyzed by a postal authority to determine the authenticity of the printed indicia on the selected mailpiece. Thus, while the scanning of every single mailpiece being processed may not be considered practical, random sampling of individual mailpieces would likely identify any large scale fraudulent indicia printing operation.

The use of the above-discussed modular metering systems has provided great flexibility in postage meter system design. For example, individual accounting and printing modules can be easily replaced, if defective, without having to return the entire metering system to the postal authority. Moreover, the enhancements in encrypted security techniques have even led to the development of personal computer metering concepts where non-dedicated computer printers are used to print the postage indicia. In addition, where portable accounting devices are used, the metering system user is provided with a great deal of operational flexibility because any number of portable accounting devices can be inserted into any single base module for the purpose of printing postage. Thus, a company can have a central base module and allocate individual portable postage vaults to different departments. Since each portable vault can be controlled via software to have a postage fund limit, flexibility is provided in that individual departments can easily place postage on items to be mailed while individual accounting and postage expenses are carefully monitored in each portable vault. This same concept can also be used to locate a base module at a central location in a community, such as a convenience store. Individuals could then obtain portable vaults for use in the central base module so that postage could be applied to their individual mailpieces. Since the postage is prepaid for and accounted for in the individual portable vaults, the mailing of individual pieces of mail (or even a batch of mail) becomes easier for individuals without requiring them to procure or rent the entire base module.

While the above use of multiple portable vaults capable of being utilized in any base module is considered extremely advantageous for the reasons discussed above, it also presents a significant accounting problem for the United States Postal Service. That is, in the United States, postage meters are registered to a particular user for use in a specified zip code location. Thus, the existing postage meter tracking structure associates a specific meter serial number with a specific zip code location. Since mailpieces having an indicia imprinted thereon are only supposed to be mailed from the local post office for the zip code that matches the meter serial number, all postage revenue generated by a specific postage meter is automatically credited to the local post office which is assumed to have initiated the mailing process. This system has been considered adequate for properly crediting postage revenue to individual post offices because, prior to the proposed use of portable accounting vaults, single housed postage meters were not considered as being portable items. Thus, once the older single housed meters were installed, they would print indicia on mailpieces within the designated zip code location and all such mailpieces would typically be mailed at the corresponding local post office. However, the use of portable vaults potentially creates problems with the desired revenue accounting desired by the United States Postal Service. That is, even if each portable vault has a serial number associated therewith, which serial number is linked in the conventional manner to a specific zip code, these portable vaults are easily transported throughout the country since they are no bigger than a conventional credit card. Accordingly, if someone has an authorized portable postage vault and they use it in a base module located in a zip code region different from the zip code region associated with the authorized portable postage vault, a postage indicia will still be printed on the mailpiece. However, in this situation, since the Postal Authority accounting infrastructure is set up to assign all revenue generated by each portable postage vault to the zip code location it is assigned to, the post office that actually initiated the mailpiece mailing would not receive revenue credit.

Thus, it is desirable to provide a postage metering system which recognizes some of the benefits discussed above in connection with the use of portable postage vaults while at the same time reasonably ensuring the proper crediting of postage revenue to the post office that actually initiates the mailing process.

SUMMARY OF THE INVENTION

A postage metering system which performs a plurality of different functions including printing of postage and exchange of data with a remotely located data center to accomplish a postage fund refill of the postage metering system, a remote postage metering system inspection, and a download of location data into the postage metering system is provided and further includes a portable vault having first data indicative of location stored therein, the portable vault accounting for the value of postage printed; and a terminal which houses structure for removably receiving the portable vault, a printing mechanism for printing postage, apparatus for communicating with the data center to perform the remote postage metering system inspection, the postage fund refill of the postage metering system, and the download of location data into the postage metering system, structure for storing second data indicative of location, and apparatus for comparing the first and second data at times when the portable vault is inserted in the receiving means, for permitting operation of all of the plurality of different functions if the first and second data match, and for preventing the printing of postage while permitting the operation of at least some of the other of the plurality of different functions if the first and second data do not match. A method associated with the postage metering system is also provided.

Objects and advantages of the invention are be set forth in the description, which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

DETAILED DESCRIPTION OF THE PREFERRED EMBODIMENTS

Figure 1:
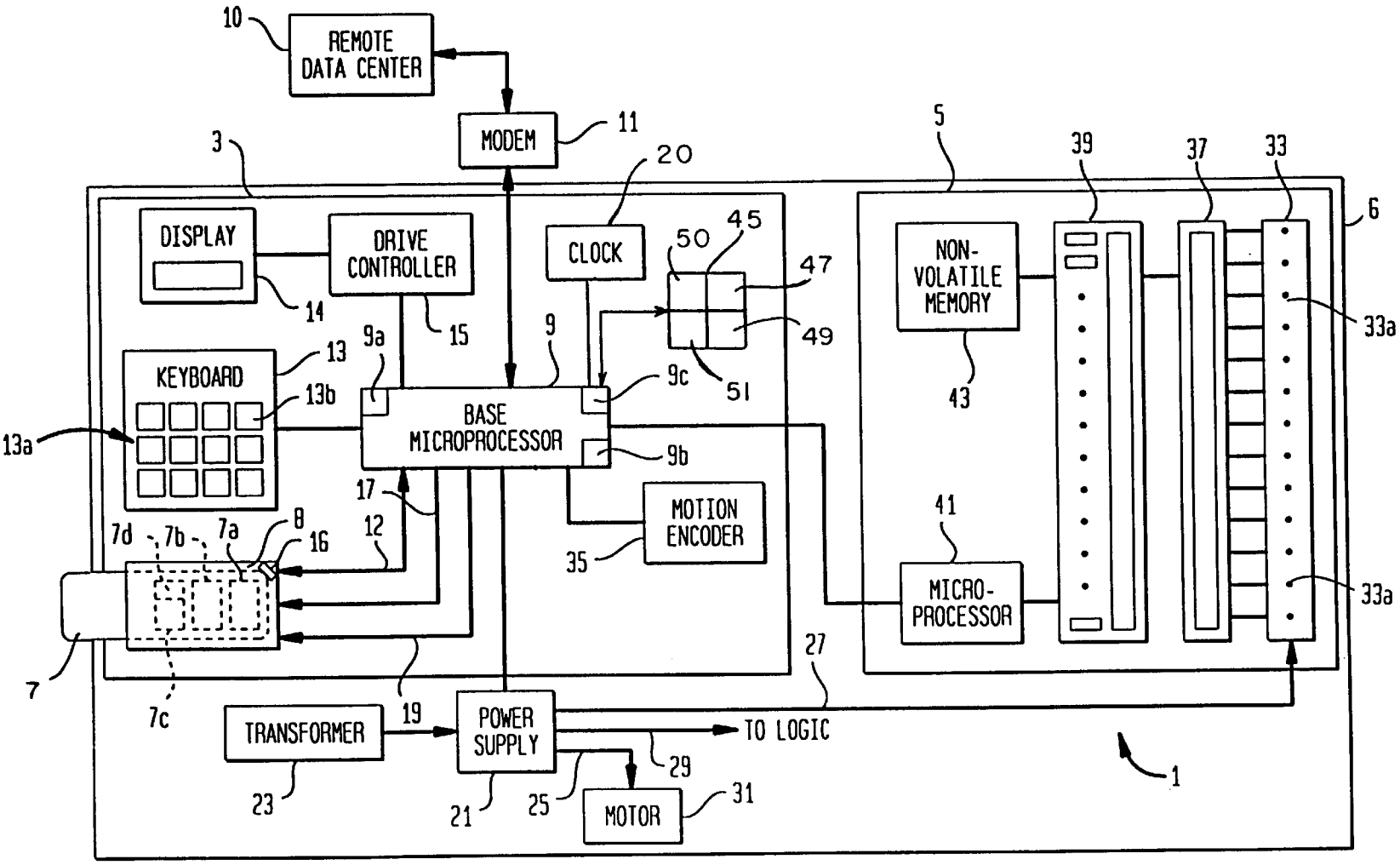
FIG. 1 is an electrical block diagram of the inventive postage metering system.

Referring to FIG. 1, a postage meter 1 includes two primary modules, a base module 3 and a printhead module 5 each of which are contained within a housing defining a single transaction terminal 6. Base module 3 includes a smart card reader 8 which receives a removable smart card vault 7, and a transaction or base microprocessor 9. Smart card vault 7 has a central processing unit 7*a*, RAM 7*b*, and non-volatile memory (NVM) 7*c* which together with the operating programs stored in ROM 7*d* allow the smart card vault 7 to perform the accounting functions of postage meter 1. That is, smart card vault 7 has the capability to have securely downloaded therein, from a remote data center 10, a predetermined amount of postage funds by securely communicating with data center 10 via a modem 11 and transaction microprocessor 9. Furthermore, during each postage transaction, smart card vault 7 checks to see if sufficient funds are available. If sufficient funds are available, smart card vault 7 debits the amount from a descending register, adds the amount to an ascending register, and sends the postage amount to the printhead module 5 via the transaction microprocessor 9. The ascending and descending registers while not shown are within NVM 7*c*. Transaction microprocessor 9 also sends date data to the printhead module 5 so that a conventional postal indicia image can be printed on a mailpiece.

Smart card vault 7 thus manages the postage funds with the ascending register representing the lifetime amount of postage funds spent, the descending register representing the amount of funds currently available, and a control sum register representing the running total amount of funds which have been credited to smart card vault 7. Additional features of smart card vault 7 which can be included are a piece counter register, encryption algorithms for encoding the information sent to the printhead module 5, and software for requiring a user to input a personal identification number which must be verified by the vault microprocessor 7 prior to its authorizing a postage transaction.

Transaction microprocessor 9 acts as a traffic cop in coordinating and assisting in the transfer of information along data line 12 between the vault microprocessor 7 and the printhead module 5, as well as coordinating various support functions necessary to complete the metering function. Transaction microprocessor 9 includes RAM 9*a*, ROM 9*b*, and central processing unit 9*c* to provide for the effective execution of meter operating programs stored in ROM 9*b* to accomplish the meter coordinating functions discussed above. Transaction microprocessor 9 also interacts with keyboard 13 to transfer user information input through keyboard keys 13*a* (such as PIN number, postage amount) to smart card vault 7. Additionally, transaction microprocessor 9 sends data to a liquid crystal display 14 via a driver/controller 15 for the purpose of displaying user inputs or for prompting the user for additional inputs. Moreover, base microprocessor 9 provides power and a reset signal to vault microprocessor 7 via respective lines 17, 19 upon detection of the insertion of smart card vault 7 into card reader 8 by a conventional electrical switch 16. A clock 20 provides date and time information to transaction microprocessor 9. Alternatively, clock 20 can be eliminated and the clock function can be accomplished by the transaction microprocessor 9.

Postage meter 1 also includes a conventional power supply 21 which conditions raw A.C. voltages from a wall mounted transformer 23 to provide the required regulated and unregulated D.C. voltages for the postage meter 1. Voltages are output via lines 25, 27, and 29 to a printhead motor 31, printhead 33 and all logic circuits. Motor 31 is used to control the movement of the printhead relative to the mailpiece upon which an indicia is to be printed. Base microprocessor 9 controls the supply of power to motor 31 to ensure the proper starting and stopping of printhead 33 movement after smart card vault 7 authorizes a transaction.

Base module 3 also includes a motion encoder 35 that processes the movement of the printhead motor 31 so that the exact position of printhead 33 can be determined. Signals from motion encoder 35 are sent to printhead module 5 to coordinate the energizing of individual printhead elements 33*a* in printhead 33 with the positioning of printhead 33. Alternatively, motion encoder 35 can be eliminated and the pulses applied to stepper motor 31 can be counted to determine the location of printhead 33 and to coordinate energizing of printhead elements 33*a*.

Printhead module 5 includes printhead 33, a printhead driver 37, a drawing engine 39 (which can be a microprocessor or an Application Specific Integrated Circuit (ASIC)), a microprocessor 41 and a nonvolatile memory 43. NVM 43 has stored therein image data of the fixed indicia and image data for each individual font that can be required as part of the variable data. Microprocessor 41 receives a print command, postage amount, and date via the transaction microprocessor 9. The postage amount and date are sent from microprocessor 41 to the drawing engine 39 which then accesses non-volatile memory 43 to obtain image data therefrom which is then downloaded by the drawing engine 39 to the printhead driver 37 in order to energize individual printhead elements 33*a* to produce a single column dot pattern of the indicia. The individual column-by-column generation of the indicia is synchronized with movement of printhead 33 until the full indicia is produced.

In addition to portable postage vault 7, a second postage meter vault 45 (including an NVM 47, RAM 49, ROM 50 and CPU 51) can be included in base module 3. Vault 45 operates in an identical manner to portable vault 7 except that it is not designed to be removable. Rather, vault 45 acts as a base module vault which accounts for postage dispensed whenever a portable postage vault 7 is not inserted into base module 3. Thus, as described in U.S. Ser. No. 08/700,922 now U.S. Pat. No. 5,731,980 filed Aug. 23, 1993 and entitled "ELECTRONIC POSTAGE METER SYSTEM HAVING INTERNAL ACCOUNTING SYSTEM AND REMOTE EXTERNAL ACCOUNTING SYSTEM", which is hereby incorporated by reference, when a portable vault 7 is inserted into the base module 3, the postage metering system automatically defaults to the portable postage vault 7 for the counting of postage dispensed. This dual vault metering system allows for operation of the postage meter 1 in a conventional manner without a portable vault 7 by utilizing the internal vault 45 while at the same time permitting the use of external portable vaults 7 for the benefits previously discussed.

In order to overcome the accounting problem previously identified in connection with portable vaults, the inventive postage meter 1 ensures that any portable vault 7 which is inserted into a base module 3 must have a zip code data (data indicative of location) stored therein which matches a zip code data stored in NVM 43 of printhead module 5 prior to authorizing printing of the requested postage amount on a mailpiece. That is, each portable vault 7 issued by the postal authority will have its serial number and a zip code for which that portable postage vault 7 is authorized for use stored in NVM 7*c*. Likewise, each internal vault 45 has a serial number and authorized zip code region associated therewith stored in NVM 45. Additionally, print module 5 has the zip code associated with the internal vault serial number stored in NVM 43. Thus, as discussed in more detail below, if the zip code data stored in the portable vault 7 does not match one of the zip code data stored in the internal vault 45 or the printhead module 5, the printing of postage is not enabled. Moreover, in the preferred embodiment, all of the programming associated with the comparison of zip code data in connection with enabling or disabling operation of the postage meter 1 is stored in ROM 9*b* of base microprocessor 9.

Figure 2:
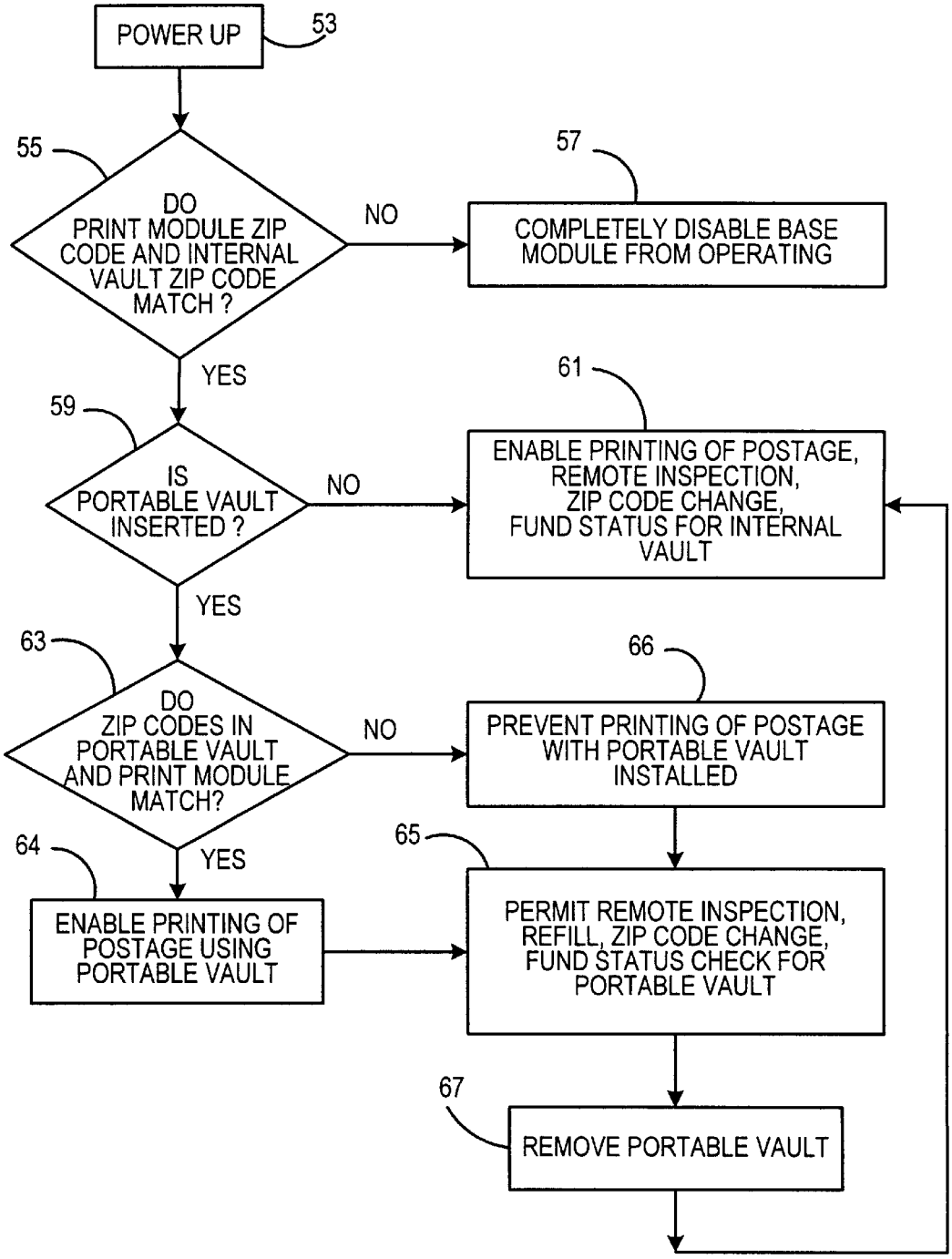
FIG. 2 is a flow chart of the postage metering system zip code check system.

Referring to FIG. 2, the operation of the inventive postage meter 1 will be described. At step 53, the postage meter 1 is provide with operating power. Base microprocessor 9 then queries both the internal vault 45 and the printhead module 5 as to the zip code data respectively stored therein and compares the data received to determine if they are indicative of the same location (for example, the same zip code) (step 55). If the answer to the comparison at step 55 is NO, the transaction terminal 6 is completely disabled from performing any operations at all and must be returned to a designated facility before it can be put back into operation (step 57). The reason that the terminal 6 is completely disabled from performing any operations if the comparison discussed above is negative, is because in this situation it is assumed that the meter is either operating incorrectly or an attempt has been made to utilize an unauthorized internal vault or an unauthorized printhead module. That is, subsequent to installation, the internal vault zip code data and the printhead module zip code data should always match since neither component is intended to be replaced without notification to the Postal Authority or its design ee and without accomplishing such replacement as discussed further below.

Assuming that the inquiry at step 55 is YES, then base microprocessor 9 determines whether a portable vault 7 has been inserted into smart card reader 8 via the indication provided by switch 16 (step 59). If the answer is NO, the postage meter 1 is enabled via utilization of the internal vault 45 to perform any of its normal functions including dispensing postage, performing remote inspections with data center 10, having funds downloaded therein from data center 10, having the zip code data in the internal vault 45 changed, and checking the status of funds in the internal vault 45 (step 61). On the other hand, if the answer at step 59 is YES, base microprocessor 9 obtains the zip code data stored in portable vault 7 and determines if it matches the zip code data of printhead module 5 (step 63). If the answer is YES, the postage meter 1 is enabled via utilization of the portable vault 7 to print postage (64) and perform any of its normal functions as discussed above in connection with step 61 as related to use of the internal vault 45 (step 65). However, if the answer at step 63 is NO, the postage meter 1 is not completely disabled as discussed above in connection with step 57 but is prevented from printing postage (step 66). However, all other functions associated with operation of the postage meter 1 utilizing the portable vault 7 such as remote inspection, zip code change, funds recharging, and funds status check can all still be performed (step 65).

One fundamental reason as to why the postage meter 1 is not completely disabled (as in step 57) when the answer at step 63 is NO is to accommodate the need for changing the zip code of portable vaults 7 when a terminal 6 and its associated portable vaults 7 are requested by a user to be moved to a new zip code location. That is, if a user is authorized to move terminal 6 to a new zip code location, the zip code data stored in internal vault 45 and printhead module 5 will be remotely changed to reflect the new location as described in more detail below. However, once these zip code data are changed, the zip code data stored in the portable vaults 7 will still correspond to the old zip code location. Accordingly, when the terminal 6 is powered up and the comparison of step 63 is made, the answer will be NO. At this point, if the postage meter 1 were completely disabled, it could not operate at all, even with respect to the internal vault 45, despite the fact that the zip code data in the internal vault 45 and the printhead module 5 matched. Moreover, there would be no way to remotely change the zip code data in the portable vaults 7 to reflect the new zip code location. Thus, the user would have to physically return the portable vaults 7 to a meter manufacturer or a local postal authority to either have the zip code data stored therein changed to correspond to the new location or a new replacement portable vault would have to be issued with the new zip code data stored therein. Thus, in order to permit easy and effective meter movement for users having a terminal 6 and multiple portable vaults 7, the entire metering system is not disabled if the zip code data in the portable vault 7 does not match the zip code data in the printhead module 5. Rather, the printing of postage utilizing the inserted portable vault 7 is prevented while the capability to change the zip code data in portable vault 7 via terminal 6 still remains functional.

Yet another reason for not disabling the entire postage meter 1 when the answer at step 63 is NO is to a permit remote inspection of an inserted portable vault 7 to be accomplished. That is, postage meters now have the capability of being remotely inspected via communication with a data center 10 as described in U.S. patent application Ser. No. 08/701,947 filed Aug. 23, 1996 now U.S. Pat. No.

5,799,093 and entitled "PROCESS AND APPARATUS FOR REMOTE SYSTEM INSPECTION OF A VALUE DISPENSING MECHANISM SUCH AS A POSTAGE METER" which is hereby incorporated by reference. The remote inspection process allows the data center to obtain operating data from the postage meter 1 which can then be analyzed to identify whether the meter is operating properly or if potential tampering of the postage meter has occurred. It is also known, in order to ensure that these remote inspections are accomplished on a periodic basis, to incorporate a meter lock out feature in the postage meter. That is, the postage meter is programmed to disable itself from operation in the event a remote inspection with the data center has not been accomplished within a predetermined period of time. Accordingly, if a user of a portable vault 7 is remotely located from their terminal 6 when an upcoming remote inspection lock out period related to the portable vault 7 is about to expire, they can insert the portable vault 7 into any terminal 6 to accomplish the required inspection despite the fact that the stored zip code data in the terminal 6 and the portable vault 7 does not match. That is, even though the answer at step 63 will be NO, remote inspection capability can still be achieved thereby preventing the lock out of portable vault 7.

At step 67, portable vault 7 is removed from terminal 6. The postage meter 1 then returns to step 61 permitting its operation as a fully functional postage meter utilizing the internal vault 45 for postage accounting.

While the above description explained the operation of the postage meter 1 when the portable vault 7, internal vault 45 and printhead module 5 all had zip code data respectively stored therein, the following description sets forth the initialization process for various postage meter 1 modules that do not have stored zip code data. As background for this description, it is important to note that as part of the initial licensing process for existing internal vault only postage meters, each vault serial number is stored at the data center with a corresponding licensed zip code location. The Assignee of the instant application has a postage meter known as the Personal Post Office™ which makes use of the information stored at the data center as part of the initialization process for new meters. That is, when a user receives a new meter it must be initialized before it is enabled to print postage. As part of the initialization process a flag is initially set in the printhead module of the postage meter identifying the meter as not having zip code data stored therein. Thus, the meter will not operate until the data center is remotely connected to the new meter and the new meter requests that the appropriate zip code data be downloaded therein. This remote download of zip code data allows postage meters to be packaged and prepared for shipment to any new user. When a user is identified for a new postage meter, the new postage meter can be shipped without requiring initialization at the postage meter manufacturer's site. Since the license process links the new postage meter to the user and a specific zip code, the initialization and initial zip code data download for the new postage meter is accomplished remotely at the user site saving a great deal of time and effort and thereby ensuring delivery of the new meter in a very expeditious manner. The instant invention makes use of the existing internal vault only postage meter initialization infrastructure to accommodate both the initialization of internal and external vaults and to effectuate approved postage meter moves to a new zip code location as described below.

Meter Initialization Process

Figure 3:
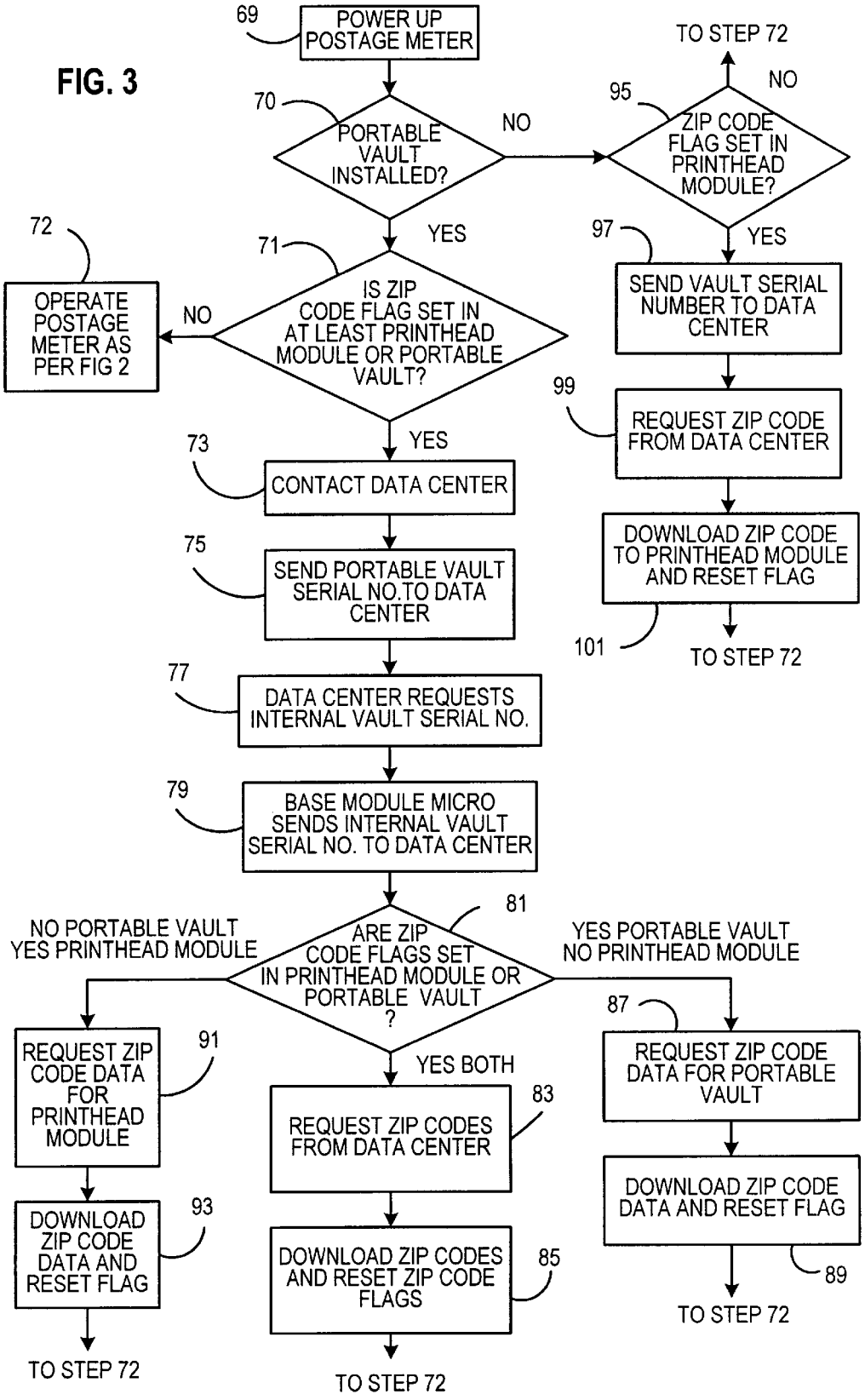
FIG. 3 is a flow chart of the postage metering system initialization procedures.

FIG. 3 sets forth the initialization process for various situations where at least one of the printhead module 5 and the inserted portable vault 7 have not been initialized to have zip code data stored therein. In the preferred embodiment, the zip code data stored in internal vault 45 is automatically made to match the zip code data stored in printhead module 5. Thus, when the below description refers to changes in the zip code data stored in printhead module 5, a corresponding change is made in internal vault 45 although not specifically discussed below. Moreover, the data center 10 has stored therein zip code data associated with each internal and portable vault serial number as part of the licensing process. Referring now to step 69, the postage meter 1 is powered up. The base microprocessor 9 then determines if a portable vault 7 is currently inserted in card reader 8 by way of an indication provided by switch 16 (step 70). If the answer at step 70 is YES, the program proceeds to step 71 where the base microprocessor 9 queries both the printhead module 5 and the inserted portable vault 7 to ascertain if a flag has been set in either of those modules indicating the need to be initialized with zip code data. If the answer at step 71 is NO, the meter is ready to operate in accordance with the steps set forth in FIG. 2 (step 72). However, if the answer at step 71 is YES, the user at step 71 is advised via display 14 to contact the data center 10 to initialize the postage meter 1. The user can then establish communication between the postage meter 1 and the data center 10 (step 73) by pressing a predesignated key on keyboard 13 and the postage meter 1 sends the serial number of the portable vault 7 to the data center 10 (step 75) which recognizes the serial number as being a portable card. The data center 10 then requests the serial number of the internal vault (step 77) which is provided by the postage meter 1 (step 79). The base microprocessor 9 then determines whether the respective flags identifying the need for zip code data have been set in both the portable vault 7 and printhead module 5 (step 81). If the answer at step 81 is YES for both, it represents the situation where both the printhead module 5 and inserted portable vault 7 need to be initialized with zip code data. At step 83 the postage meter 1 requests zip code data for portable vault 7 and printhead module 5. The data center 10 downloads the appropriate zip code data to base microprocessor 9 which provides the respective data to portable vaults 7 and printhead module 5 and resets the flags in both the portable vault 7 and printhead module 5 to identify that zip code data is not required for these modules (step 85). At this point, the postage meter 1 operates in accordance with FIG. 2.

Returning to step 81, if the answer is that only the portable vault 7 needs zip code data it represents the situation where an initialized terminal 6 printhead module 5 has a portable vault 7 inserted therein which has not been initialized. Base microprocessor 9 requests the zip code data for the inserted portable vault 7 (step 87) and receives and downloads the zip code data from data center 10 and resets the flag in portable vault 7 to reflect that no zip code data is needed (step 89). The postage meter 1 then operates in accordance with FIG. 2.

At step 81, if the answer is that only the printhead module 5 needs zip code data it represents the situation where an initialized portable vault 7 is being used in conjunction with a terminal 6 having an uninitialized printhead module 5 which can occur when a new terminal is provided or a new printhead module 5 has been put into an existing terminal 6. Base microprocessor 9 thus requests (step 91) and receives zip code data from data center 10 and loads it into printhead module 5 while resetting the flag in printhead module 5 to reflect that zip code data is no longer needed therein (step 93). The postage meter 1 is then ready to operate in accordance with FIG. 2.

Returning to step 70, if the answer to the inquiry is NO, the base microprocessor determines (step 95) if a flag is set in printhead module 5 identifying the need for zip code data. If the answer is NO, the postage meter 1 operates in accordance with FIG. 2. However if the answer is YES, the base microprocessor 9 contacts the data center 10 and sends the internal vault 45 serial number to data center 10 (step 97). Then (step 99) the base microprocessor 9 requests the inte30 data from dacode data from data center 10. At step 101, the data center 10 sends the zip code data to base microprocessor 9 which downloads it into the printhead module 5 and resets the flag in the printhead module 5 to reflect that zip code data is not needed. The postage meter 1 is then ready to operate in accordance with FIG. 2.

Relocation of Postage Meters

Figure 4:
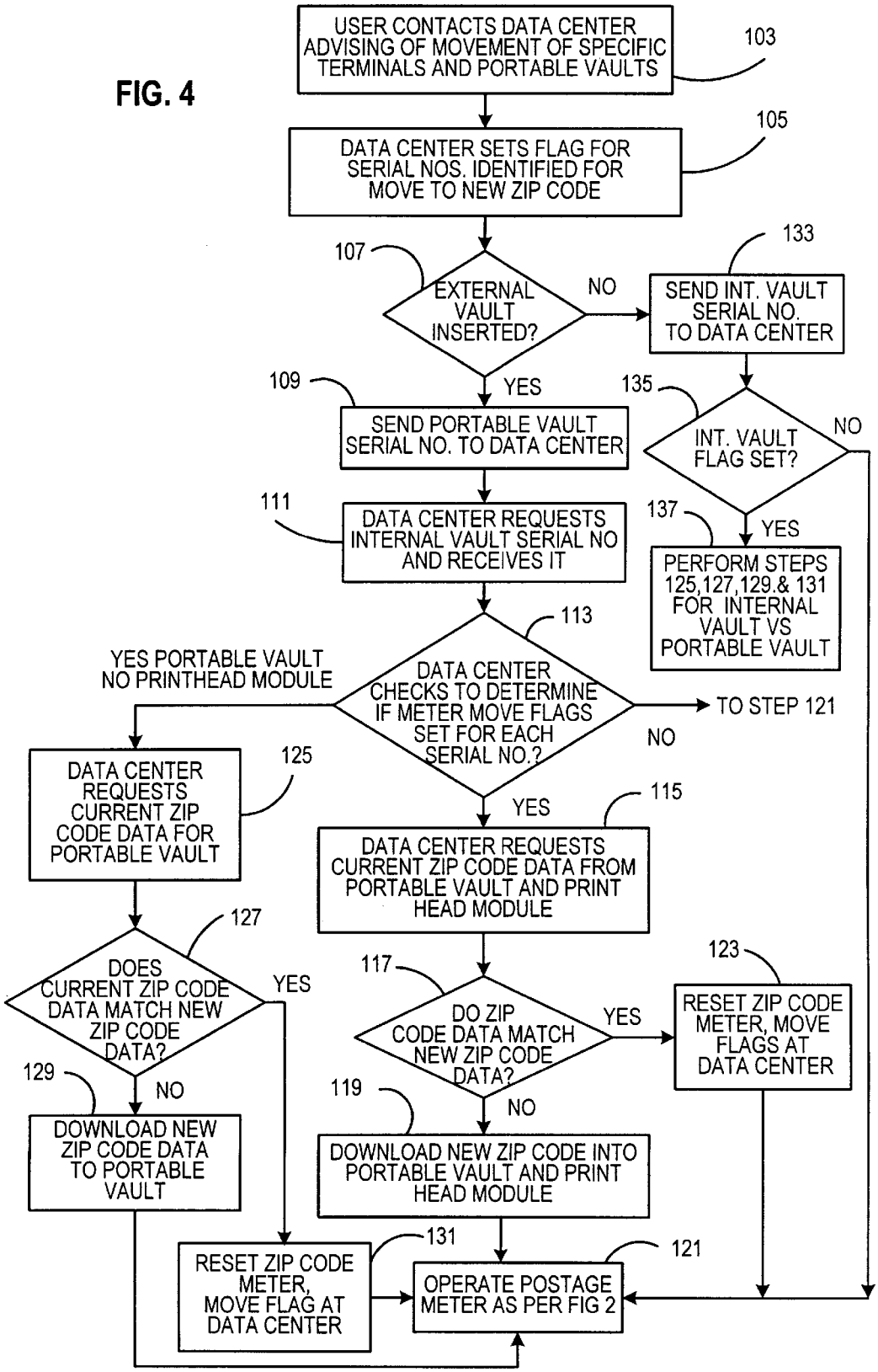
FIG. 4 is a flow chart of the postage metering system relocation procedures.

FIG. 4 sets forth the programming in base microprocessor 9 for various postage meter relocation situations which can arise. In step 103, the user contacts the data center and identifies by serial number each portable vault 7 and internal vault 45 which are to be relocated to a new zip code location. In data center 10 each identified vault serial number is associated with the new zip code location data and a flag is set for each vault serial number to identify that a meter move has been requested (105). At the next communication between postage meter 1 and the data center 10, base microprocessor 9 determines whether a portable vault 7 is inserted into postage meter 1 (step 107). If the answer is YES, base microprocessor 9 sends the portable vault 7 serial number to data center 10 (step 109), and data center 10 requests the internal vault serial number and the base microprocessor 9 sends it to data center 10 (111). At step 113, data center 10 checks to see if a meter relocation flag has been set for each vault serial number. If the answer is YES for both the internal vault 45 and the inserted portable vault 7, the data center 10 requests the current zip code data stored in both the portable vault 45 and the printhead module 5 (step 115). At step 117, the data center 10 compares the received zip code data with the new zip code location data to determine if they match. If they do not match, the data center 10 knows the zip code data change has not occurred and therefore it downloads the new zip code data into the inserted portable vault 7 and the printhead module 5 (step 119). At this point, the postage meter 1 operates in accordance with FIG. 2 (step 121). Returning to step 117, if the answer is YES, the data center 10 resets the relocation flags for the internal and portable vaults 45 and 7 so that they are no longer designated for relocation (step 123). This situation would arise the next time a postage meter 1 contacts the data center 10 after an approved zip code data change has effectively occurred. That is, after step 119 the data center 10 still has the flags set identifying a relocation requirement for each vault 45, 7. Thus, only upon the next communication with the data center 10 does the data center 10 verify that the necessary zip code data change has occurred when the answer at step 117 is YES.

Returning to step 113, if it is determined that the portable vault 7 has been flagged for a relocation but the internal vault 45 has not, the data center 10 requests the current zip code data stored in the inserted portable vault 7 (step 125). Then, at step 127 the data center determines if the received zip code data matches the new zip code data stored therein. If the answer is NO, the new zip code data is downloaded into the inserted portable vault 7 (step 129). If the answer however is YES, the data center 10 resets the flag associated with the inserted portable vault so that it no longer is tagged for relocation (131). After both steps 129 and 131, the postage meter 1 operates in accordance with FIG. 2 (step 121).

The immediately described situation occurs where new zip code data is needed in a portable vault but not in an internal vault. As discussed above, even though the zip code data in the printhead module 5 and the inserted portable vault 7 do not match, the downloading of new zip code data to the portable vault 7 can still be accomplished since, as reflected in FIG. 2, the postage meter 1 is not completely disabled from functioning. Furthermore, although not shown in FIG. 4, at step 113 it is possible that only the internal vault 45 is flagged for relocation. If such is the case, the steps 125, 127, 129, and 131 are performed in connection with the internal vault 45 instead of the inserted portable vault 7.

Returning once again to step 113, if the answer is NO, the postage meter operates in accordance with FIG. 2. This situation occurs when neither vault is flagged for relocation.

In the event that no portable vault 7 has been inserted into postage meter 1, the answer at step 107 is NO. Thus, at step 133 the internal vault serial number is sent from postage meter 1 to data center 10. At step 135 data center 10 checks to see if a relocation flag is set for the received vault 45 serial number. If the answer is NO, the postage meter 1 operates in accordance with FIG. 2 (step 121). However, if the answer is YES the steps 125, 127, 129 and 131 are performed for the internal vault instead of for a portable vault as stated in step 137.

Additional advantages and modifications will readily occur to those skilled in the art. Therefore, the invention in its broader aspects is not limited to the specific details and representative devices, shown and described herein. Accordingly, various modifications may be made without departing from the spirit or scope of the general inventive concept as defined by the appended claims. For example, since both the internal vault and external vault have a serial number associated therewith both serial numbers can be printed by the postage meter 1 together with the postage indicia. This would provide another audit capability for tracking the use of portable vaults 7 with internal vaults 45. Moreover, in yet another embodiment there is no internal vault 45. Rather, the meter serial number and location data typically stored in the internal vault is stored within terminal 6. This stored data is utilized identically as described in connection with the internal vault 45, its just that the terminal 6 does not have an internal vault accounting capability. Accordingly, in this configuration, dispensing of postage can only occur when the portable vault 7 is inserted in terminal 6.

What is claimed is:

1. A postage metering system which performs printing of postage and exchange of data with a remotely located data center to accomplish at least some of the functions of a postage fund refill of the postage metering system, a remote postage metering system inspection, and a download of location data into the postage metering system, the postage metering system comprising:

a portable vault having first data indicative of location stored therein, the portable vault accounting for the value of postage printed; and a terminal which houses means for removably receiving the portable vault, a printing mechanism for printing postage, means for communicating with the data center to perform the at least some of the functions, means for storing second data indicative of location, and means for comparing the first and second data at times when the portable vault is inserted in the receiving means, for permitting operation of the printing of postage and the at least some of the functions if the first and second data match, and for preventing the printing of postage while permitting the exchange of data with the remotely located data center to permit operation of the at least some of the functions if the first and second data do not match.

2. A postage metering system as recited in claim 1, wherein the at least some of the functions is the download of location data into the postage metering system.

3. A postage metering system as recited in claim 2, wherein the at least some of the functions include the postage fund refill of the postage metering system and the remote postage metering system inspection.

4. A postage metering system as recited in claim 1, wherein the at least some of the functions is the remote postage metering system inspection.

5. A postage metering system as recited in claim 1, wherein the at least some of the functions is the postage fund refill of the postage metering system.

6. A postage metering system as recited in claim 1, wherein the printing mechanism includes the storing means.

7. A postage metering system as recited in claim 6, further comprising an internal vault mounted in the terminal which accounts for the value of postage printed at times when the portable vault is not inserted in the receiving means, the internal vault having third data indicative of location stored therein; and wherein the comparing means compares the second data to the third data and completely disables operation of the printing of postage and all of the at least some of the functions if the second data and the third data do not match.

8. A postage metering system as recited in claim 7, wherein the first, second and third data are all zip code data.

9. A method for linking operation of a postage metering system to a designated location, the postage metering system including a terminal which houses a printing mechanism for printing postage and a portable vault which accounts for the value of postage printed by the printing mechanism, the method comprising the steps of:

storing first data indicative of location in the portable vault;

storing second data indicative of location in the terminal;

inserting the portable vault into the terminal to establish communication therebetween;

comparing the first and second data within the terminal and at times when the first and second data match enabling operation of the postage metering system with complete functionality and at times when the first and second data do not match preventing the printing of postage by the postage metering system while enabling the postage metering system to communicate with a remote data center for performing at least one of remotely inspecting the portable vault, downloading new data indicative of location into the portable vault to replace the first data, withdrawing funds from the portable vault, and recharging postage funds into the portable vault.

* * * * *